US005609267A

United States Patent [19]

Johnson et al.

[11] Patent Number: 5,609,267

[45] Date of Patent: Mar. 11, 1997

[54] CORROSION-RESISTANT STORAGE TANK FOR RUNOFF LIQUIDS

[75] Inventors: Malcolm L. Johnson; Jimmy J. Lee, both of Plano, Tex.

[73] Assignee: Phillips Petroleum Company, Bartlesville, Okla.

[21] Appl. No.: 506,748

[22] Filed: Jul. 26, 1995

[51] Int. Cl.[6] ..... B65D 25/22

[52] U.S. Cl. ..... 220/751; 220/565; 220/4.13; 220/676

[58] Field of Search ..... 220/676, 565, 220/4.12, 4.13, 4.16, 469, 751

[56] References Cited

U.S. PATENT DOCUMENTS

| | | | |
|---|---|---|---|
| 3,505,769 | 4/1970 | Miron et al. | 52/249 |
| 3,904,439 | 9/1975 | Barrett, Jr. | 220/751 |
| 4,036,390 | 7/1977 | Morse | 220/565 |
| 4,553,561 | 11/1985 | Morris | 220/4.13 |
| 4,697,618 | 10/1987 | Youtt et al. | 220/565 |
| 4,715,513 | 12/1987 | Shelton, Jr. | 220/4.12 |

FOREIGN PATENT DOCUMENTS

| | | | |
|---|---|---|---|
| 645628 | 10/1928 | France | 220/751 |

*Primary Examiner*—Stephen J. Castellano
*Attorney, Agent, or Firm*—Ryan N. Cross

[57] ABSTRACT

A corrosion-resistant storage tank for collecting runoff liquids is provided. The storage tank is formed from a plastic and has a bottom; a vertical side wall having at least one aperture, and a removable cap having at least one cap aperture therein and at least one flange positioned in the cap aperture.

2 Claims, 2 Drawing Sheets

CORROSION-RESISTANT STORAGE TANK FOR RUNOFF LIQUIDS

BACKGROUND OF THE INVENTION

In one aspect, the invention relates to a storage tank suitable for the containment of runoff liquids. According to another aspect, the invention relates to a storage tank for runoff liquids that is more economical than prior storage tanks.

Due to environmental reasons, the runoff liquids from compressors, pumps and engines located at pipeline pressure booster stations along oil and gas gathering and transmission lines must be collected for proper disposal. These runoff liquids are generally comprised of mostly rainwater but can contain minor portions of corrosive fluids such as crude petroleum oil stock, fuel oils, kerosene, gasolines, propane, butane, etc.

Prior art methods of constructing storage tanks for these runoff liquids have included building reinforced concrete vaults in which a steel tank is placed for the runoff liquids to flow into by gravity. The steel tank is likely to corrode and develop holes and, therefore the concrete vault is needed to serve as a secondary tank to prevent seepage of runoff liquids into the surrounding soil. These storage tanks are time consuming to build and require heavy equipment on the job site. Additionally, such concrete vault reinforced tanks are costly to install.

SUMMARY OF THE INVENTION

It is, therefore, an object of the present invention to provide a corrosion-resistant storage tank that negates the need of having the concrete vault.

It is a further object of the present invention to provide a storage tank for run-off liquids that is less time consuming to build and install than prior systems and reduces the amount of heavy equipment necessary for installing the storage tank. It is yet another object of the present invention to provide a storage tank for run-off liquids that is more economical to install than prior systems.

Other objects and advantages of this invention will become apparent to those skilled in the art from the following description and the accompanying drawings.

In accordance with this invention, there is provided a corrosion-resistant storage tank for runoff liquids comprising: an enclosure having a bottom; a vertical side wall having an interior side, an exterior side and at least one wall aperture extending from the interior side to the exterior side such that an inlet conduit can be attached to the wall aperture so that the inlet conduit is in fluid flow communication with the interior of the enclosure; and a removable cap having at least one cap aperture therein and a flange positioned in the cap aperture so that the flange is in communication with the interior of the enclosure, wherein the bottom, the side wall and the cap are formed from a plastic and wherein the storage tank comprises no additional structural support.

DETAILED DESCRIPTION OF THE INVENTION

Figure 1:
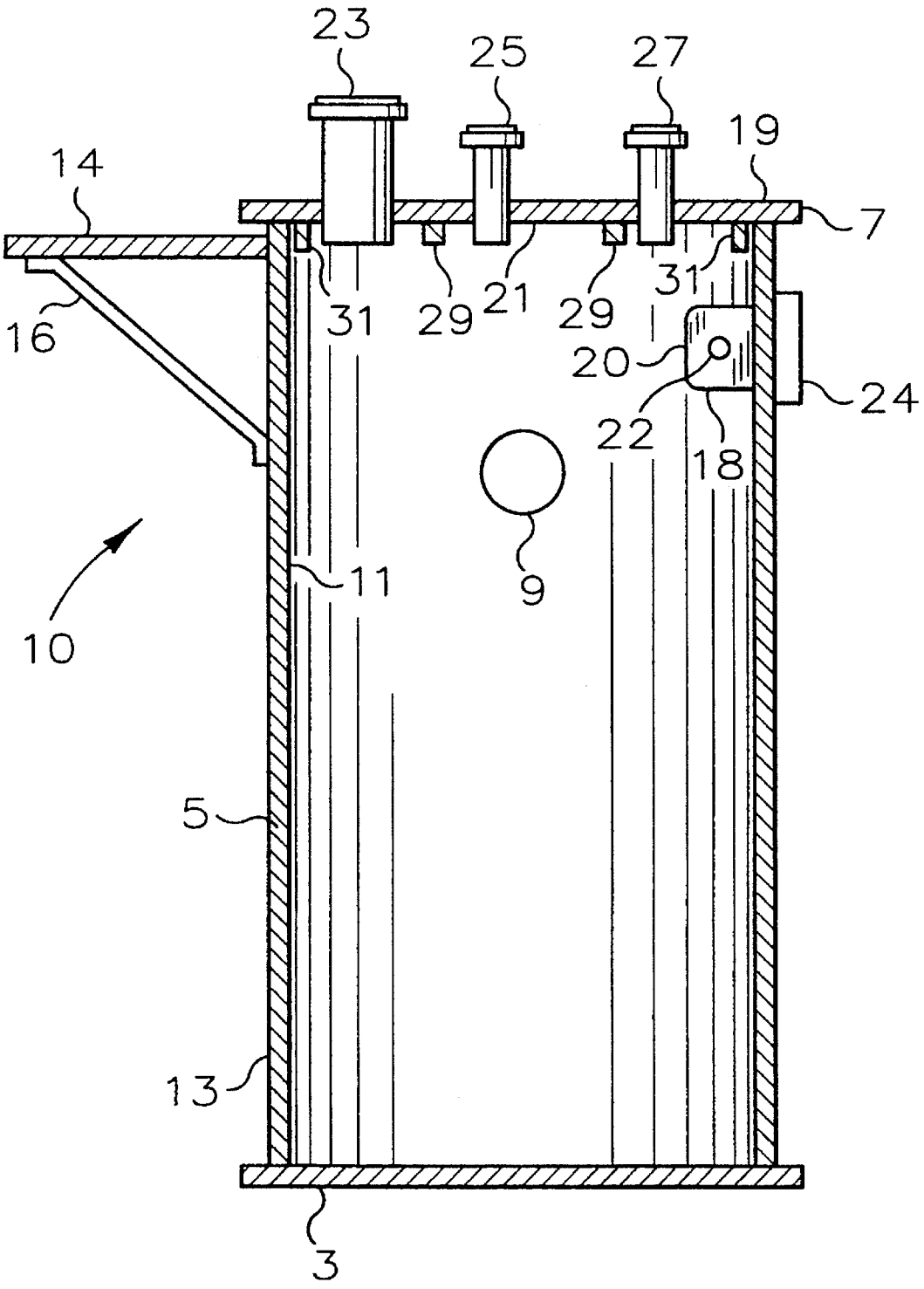
FIG. 1 is a cross-sectional view of a storage tank according to the invention.

Referring now to the figures, FIG. 1 illustrates a cross-sectional view of a corrosion-resistant storage tank 10 according to the invention in which runoff liquids from equipment, such as compressors, pumps and engines, located at pipeline pressure booster stations along oil and gas gathering and transmission lines can be collected for proper disposal. Storage tank 10 is an enclosure comprising a bottom 3, a vertical side wall 5, and a removable cap 7.

Vertical side wall 5 can be generally any shape and be formed from a single plastic sheet or from several plastic sheets welded together along their edges; however, due to ease of production it is preferred that vertical side wall 5 be formed from a cylindrical plastic tube produced by extrusion or rotation molding. Bottom 3 is comprised of a single plastic disk and is welded onto the bottom end of vertical side wall 5 such that bottom 3 is fixedly secured to vertical side wall 5 without any holes or gaps through which runoff liquids could flow. Optionally, if vertical sidewall 5 is formed by rotational molding bottom 3 can be formed as an integral part thereof during the molding.

Figure 2:
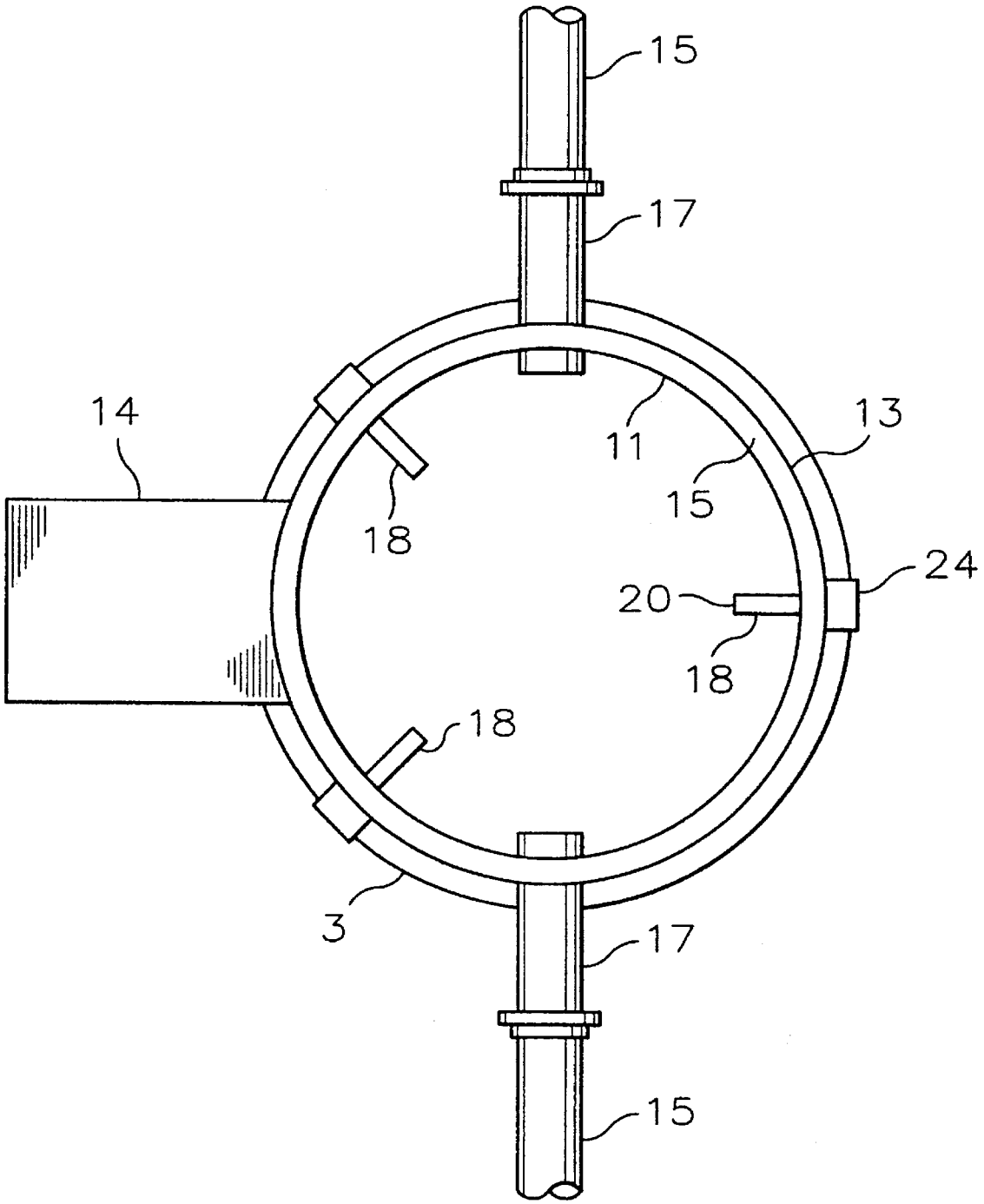
FIG. 2 is a top view of the storage tank of FIG. 1 with the cap removed.

At least one aperture 9 extends from the interior side 11 to the exterior side 13 of vertical side wall 5. The aperture 9 provides fluid flow communication from the exterior of storage tank 10 to the interior of storage tank 10. Generally, a conduit will be connected to aperture 9 by a suitable means such as by either directly inserting the conduit into aperture 9 and forming a liquid tight seal with the surrounding material of the vertical side wall, such as by butt welding or hot gas welding, or by connecting a flange into aperture 9 (as shown in FIG. 2), forming a liquid tight seal between the flange and the surrounding material of the vertical side wall and connecting the conduit to the flange to form a liquid tight seal. Thus, as can be seen from FIG. 2, runoff liquid from the equipment channeled into conduit 15 is introduced through flange 17 into the interior of storage tank 10. The runoff liquid thereby collects in storage tank 10 until it is removed as described below.

Shelf 14 is fixedly secured to the exterior 13 of vertical side wall 5 and can be further supported in position by a brace member 16. Shelf 14 thus provides a base on which to set a pump for use with storage tank 10, as described below. Additionally, lifting lugs 18 are fixedly secured to and spaced about vertical side wall 5 such that storage tank 10 can be conveniently lifted and moved by means of a crane or similar device. As illustrated in FIGS. 1 and 2, the lifting lugs 18 comprise a head portion 20 having an aperture 22 therein and a base portion 24 which is slightly broader than head portion 20. The lugs are attached by inserting the lifting lugs into an aperture in vertical side wall 5 which is comparable in size to the breadth of the head portion and welding the base to exterior 13. The lifting lugs can be attached so that head portion 20 extends into the interior of storage tank 10, as shown, or extends out from the exterior of verticle side wall 5.

Cap 7 comprises a single disk of plastic having a top portion 19, a bottom portion 21, and a series of apertures into which flanges 23, 25, and 27 are fixedly secured. Cap 7 has bracing, such as support beams 29 on its bottom portion in order to strengthen cap 7. Additionally, cap 7 has a ridge 31 on its bottom portion in order to keep cap 7 on the top end of vertical side wall 5. Ridge 31 should be positioned so that it is adjacent to the interior of vertical side wall 5 when cap 7 is placed on vertical side wall 5 and prevents movement of cap 7 in a radial direction when cap 7 is in place. Ridge 31 can comprise a single continuous ridge or a series of discrete tabs. Support beams 29 and ridge 31 can be formed as an integral part of cap 7 or can be welded or otherwise fixedly secured to the bottom portion 21.

The components of the storage tank should be made from an inert plastic so as to prevent corrosion of the components when they come into contact with corrosive runoff liquids. The cap, bottom and vertical side walls, as well as the flanges, are especially subject to corrosion because of their contact with the runoff liquids and, therefore, the use of metal or other non-inert compounds in these components is especially undesirable. By use of an inert plastic, the need for a surrounding concrete vault is eliminated and, thus, installation of the storage tank is simplified and cost is reduced. Therefore, to obtain full advantage of the more economical and easier installation of the present invention, it is preferable that the inventive storage tank be installed and used without additional structural support or secondary outer tanks, such as metal tanks or concrete vaults, surrounding the inventive storage tank. Additionally the plastic should be one which is extrudeable and/or moldable in order facilitate production of the storage tank. Particularly suitable plastics are ones selected from the group comprising polyethylene, polypropylene and copolymers thereof. Preferably the plastic is selected from the group comprising polyethylene and copolymers thereof because of their inertness and structural suitability.

In operation, the majority of storage tank 10 sits below the level of the booster station floor so that under the influence of gravity runoff liquids will tend to flow into storage tank 10. Thus, the runoff liquids from the equipment flow into drains positioned in the booster station floor. The liquids enter a series of pipes that are in fluid flow communication with flange 17 and, therefore, the interior of storage tank 10. As the liquid level rises a float, located within storage tank 10 and connected through flange 25 to a pump position on shelf 14, raises. When liquid is to be removed from storage tank 10 for disposal, the pump is activated and withdraws runoff liquid through flange 23. As the liquid is removed the float lowers. The level of the float signals the liquid level and can be used, as desired, to turn on and/or off the pump according to the liquid height. Flange 27 vents to the atmosphere to prevent build up of gases and pressure within the vessel. Generally, the pump will remove the liquid through flange 23 and pump it into a suitable truck for removal from the site or into some other suitable disposal system.

That which is claimed:

1. A corrosion-resistant storage tank for runoff liquids comprising: an enclosure having a vertical side wall formed from a cylindrical plastic tube having an interior side, an exterior side and at least one wall aperture extending from said interior side to said exterior side such that an inlet conduit can be attached to said wall aperture so that said inlet conduit is in fluid flow communication with the interior of said enclosure such that runoff liquids can be introduced into said enclosure; a bottom welded onto the bottom end of said vertical side wall; a removable cap having a first aperture and a first flange positioned in said first aperture such that any fluid contained within said enclosure can be pumped out through said first flange, a second aperture and a second flange positioned in said second aperture such that gas within said enclosure can be vented from said enclosure, and a third aperture and a third flange positioned in said third aperture such that the level of runoff liquid within said enclosure can be determined through said third flange; a shelf attached to the exterior surface of said vertical side wall suitable for supporting a pump for pumping fluids contained within said enclosure out through said first flange; and lifting lugs attached to said vertical side wall wherein said lifting lugs are spaced apart on said vertical side wall such that said storage tank can be lifted by attaching a lifting means to said lifting lugs, wherein said bottom, said vertical side wall and said cap are formed from a plastic selected from the group comprising polyethylene, polypropylene and copolymers thereof and wherein said storage tank comprises no additional structural support.

2. A storage tank according to claim 1 wherein said bottom, said side wall and said cap are formed from polyetheylene.

* * * * *